US009725277B2

(12) United States Patent
Schröter et al.

(10) Patent No.: US 9,725,277 B2
(45) Date of Patent: Aug. 8, 2017

(54) WINDING MACHINE

(71) Applicant: Oerlikon Textile GmbH & Co. KG, Remscheid (DE)

(72) Inventors: Michael Schröter, Remscheid (DE); Friedrich Lennemann, Neumünster (DE); Klaus Schäfer, Remscheid (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 82 days.

(21) Appl. No.: 14/762,975

(22) PCT Filed: Jan. 8, 2014

(86) PCT No.: PCT/EP2014/050209
§ 371 (c)(1),
(2) Date: Jul. 23, 2015

(87) PCT Pub. No.: WO2014/114490
PCT Pub. Date: Jul. 31, 2014

(65) Prior Publication Data

US 2015/0353317 A1 Dec. 10, 2015

(30) Foreign Application Priority Data

Jan. 24, 2013 (DE) ..... 10 2013 001 152

(51) Int. Cl.
*B65H 54/28* (2006.01)
*B65H 67/048* (2006.01)
*B65H 54/74* (2006.01)

(52) U.S. Cl.
CPC ..... *B65H 54/28* (2013.01); *B65H 54/74* (2013.01); *B65H 67/048* (2013.01); *B65H 2701/31* (2013.01)

(58) Field of Classification Search
CPC .... B65H 67/048; B65H 67/052; B65H 54/28; B65H 54/74; B65H 2701/31
See application file for complete search history.

(56) References Cited

U.S. PATENT DOCUMENTS 1,809,660 A 6/1931 Wild et al.

FOREIGN PATENT DOCUMENTS

| | | | |
|---|---|---|---|
| CN | 1237143 | A | 12/1999 |
| CN | 1273559 | A | 11/2000 |
| DE | 496381 | C | 4/1930 |
| DE | 529699 | C | 2/1932 |
| DE | 543146 | C | 2/1932 |
| DE | 102006061332 | A1 | 6/2008 |

(Continued)

*Primary Examiner* — William E Dondero
(74) *Attorney, Agent, or Firm* — BainwoodHuang

(57) ABSTRACT

A take-up winding machine continuously coils a plurality of threads. The take-up winding machine has a plurality of rotatably mounted winding turrets which, in each case, support two protruding winding spindles and which are held beside one another in a machine frame so as to be spaced apart by a pitch. The take-up winding machine further has a plurality of traversing units and a plurality of contact rollers which together with the winding turrets form a plurality of coiling positions. The winding turrets are assigned one common turret drive. The winding turrets are configured so as to be drivable in the same direction. The contact rollers and the traversing units are held on the machine frame along one machine longitudinal side so as to be symmetrical to the pitch of the winding turrets.

19 Claims, 4 Drawing Sheets

(56) References Cited

FOREIGN PATENT DOCUMENTS

Figure 1:
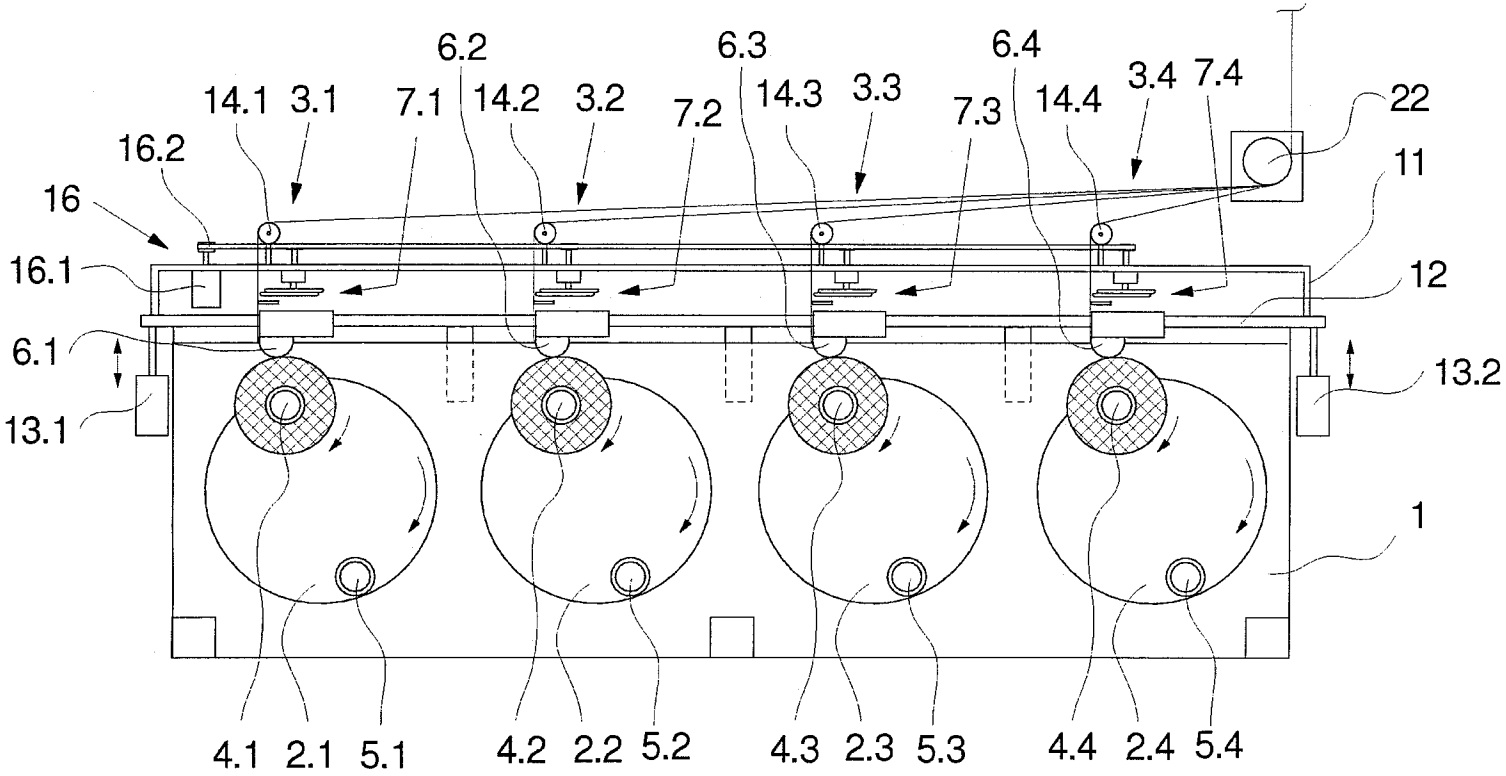

| | | | |
|---|---|---|---|
| FR | 2718157 | A1 | 10/1995 |
| WO | 9912837 | A1 | 3/1999 |
| WO | 9918024 | A1 | 4/1999 |
| WO | 2005082759 | A1 | 9/2005 |
| WO | 2005108263 | A1 | 11/2005 |
| WO | 2011144732 | A1 | 11/2011 |
| WO | 2012045855 | A1 | 4/2012 |

WINDING MACHINE

The invention relates to a take-up winding machine for continuously coiling synthetic threads as disclosed herein.

A take-up winding machine of the generic type is known from WO 2005/082759 A1, for example.

In the manufacture of synthetic threads in melt-spinning systems it is customary for the threads at the end of the process to be wound to form packages. Depending on the respective manufacturing process and the type of thread, various systems are used for coiling the threads.

In this way, a take-up winding machine which has a plurality of rotatably mounted winding turrets having in each case two protruding winding spindles is known from WO 2005/082759 A1. The winding spindles here serve for receiving a plurality of packages, such that as great a number of threads as possible may be simultaneously coiled to form packages. The winding turrets here are assigned contact rollers and traversing units which are disposed in the central region between the winding turrets. On account thereof, a very compact disposal of the assemblies within the take-up winding machine is achieved. Coiling machines of this type are preferably operated as so-called double winders which contain two winding turrets which are driven in opposite directions. Take-up winding machines of this type are thus preferably employed in melt-spinning processes in which a great number of threads are produced beside one another in parallel within one spinning position.

In the manufacture of crimped threads which are used, for example, as carpet yarn, it is also known for only a single thread to be manufactured within one spinning position. As is known from DE 10 2006 061 332 A1, for example, to this end take-up winding machines which have only one rotatable winding turret having two protruding winding spindles which are assigned one contact roller and one traversing installation for coiling the thread are employed. It is known here for the drives of the take-up winding machine to be combined with drives of adjacent take-up winding machines and to be controlled by way of group controllers. However, this typically requires additional coordinating control in order for the sequences in the take-up winding machines to be coordinated.

It is now an object of the invention to provide a take-up winding machine of the generic type for continuously coiling synthetic threads, which is flexible and suited to taking up threads of one spinning position or a plurality of spinning positions.

A further object of the invention lies in providing a take-up winding machine of the generic type which enables coiling of the threads in a plurality of thread groups using control complexity which is as low as possible.

This object is achieved according to the invention in that the winding turrets are configured so as to be drivable in the same direction and that the contact rollers and the traversing units are held on the machine frame along one machine longitudinal side so as to be symmetrical to the pitch of the winding turrets.

Advantageous refinements of the invention are defined by the features and combinations of features as disclosed herein.

The invention is distinguished in that the coiling positions on the winding turrets having the assigned contact rollers and traversing units are identically configured and thus enable the implementation of synchronous coiling of the threads on each of the winding turrets. In this way, very high uniformity in the coiling of the packages is achieved in each coiling position. On account of the drive of all winding turrets being in the same direction, the package-change operations in the adjacent coiling positions can be implemented in a synchronous manner.

In order for the positional accuracy of the winding turrets in the machine frame to be ensured, the refinement of the invention in which the turret drive is implemented by way of an electric motor and a belt drive and/or a chain drive is preferably implemented. In this way, the rotary position of the electric motor may be directly transmitted via a gear belt or a chain to the interlinked winding turrets.

In order to maintain identical conditions in each of the coiling positions as the packages grow in size during the coiling of the threads, the traversing units are preferably collectively disposed on a traverse support which extends above the winding turrets along the coiling positions.

It is particularly advantageous here for the contact rollers which are assigned to the coiling positions to be held on a movable roller support, such that the yielding movement during coiling of the threads may be performed both by a synchronous movement of the winding turrets or by moving the roller support.

In order for identical thread placement via the contact rollers to be maintained in each coiling position, according to one advantageous refinement of the invention the traverse support is supported on the roller support, such that the free thread length between the traversing installation and the contact roller is constant in each pairing of a traversing installation with a contact roller.

In order for the threads to be able to be wound to form cross-wound packages also at comparatively high take-up winding speeds, the traversing units in the coiling positions are preferably formed by in each case one wing-type traversing installation which has rotor wings which are drivable in opposite directions, wherein the wing-type traversing installations are collectively drivable by way of one traverse drive.

The traverse drive is advantageously formed by an electric motor and a belt drive, wherein each of the wing-type traversing installations is assigned a transfer case in order for the torque of the belt drive to be uniformly distributed to both rotor wings.

The winding spindles which are disposed on the winding turrets are driven by separate spindle drives. In order for synchronous coiling of the threads in the coiling positions to be ensured, according to one advantageous refinement of the invention the spindle drives of one group of winding spindles are collectively controlled by way of one group controller. In this way, in particular acceleration and deceleration actions of the winding spindle during a package change can be implemented in a synchronous manner at each of the winding turrets.

In order for identical coiling speeds to prevail during coiling of the threads at each of the winding spindles, the group controller is linked to a revolution sensor which is assigned to one of the contact rollers. In this way the revolutions of the contact roller on one of the coiling positions may be used in order to maintain identical coiling speeds at each of the adjacent winding spindles.

In order to enable thread guiding out of the spinning positions which is as flexible as possible, a plurality of deflection rollers which are held so as to be distributed across the coiling positions are provided above the traversing units. In this way, separation of the threads may be implemented with low thread friction even in the case of comparatively large deflections.

Depending on requirements, it is possible for the coiling positions within the take-up winding machine to be configured in such a manner that per coiling position one thread is coiled to form one package or per coiling position a plurality of threads are coiled to form a plurality of packages.

Figure 2:
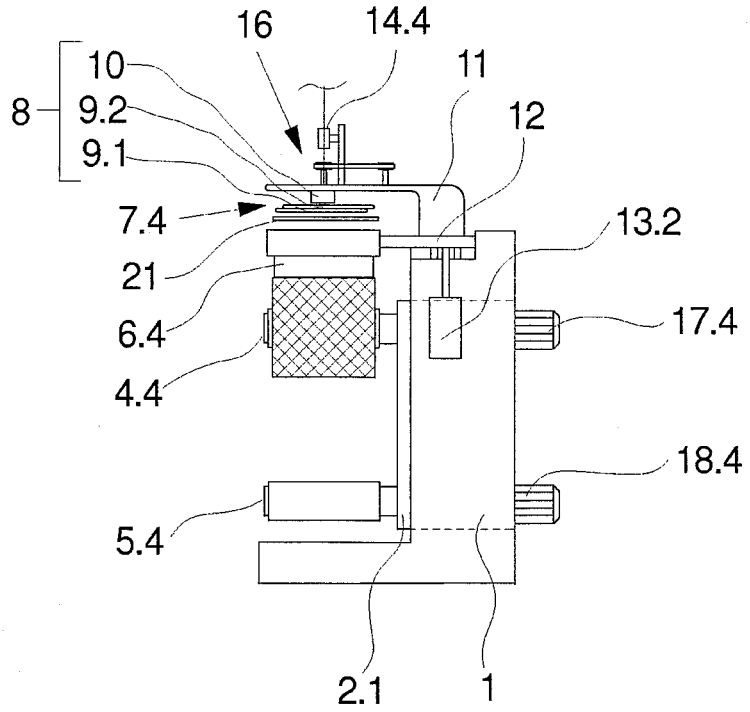
Figure 3:
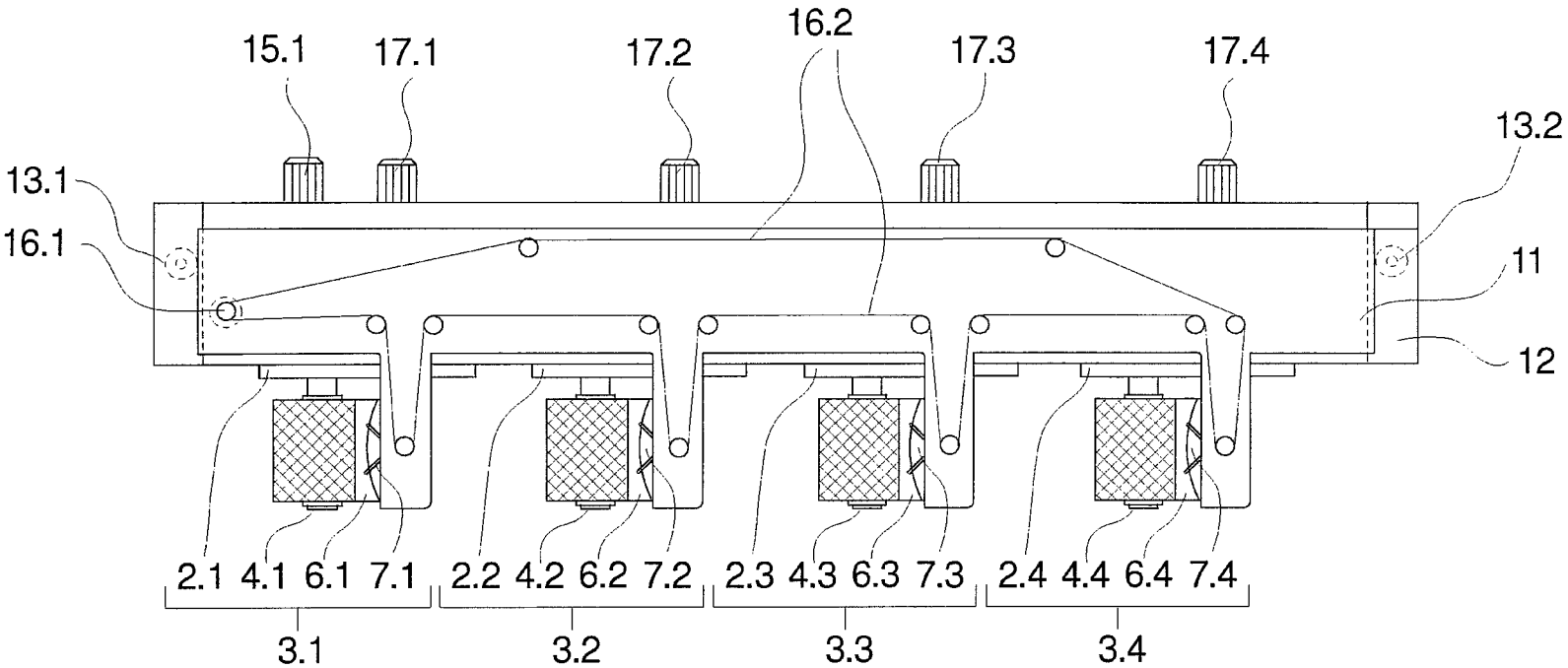
Figure 4:
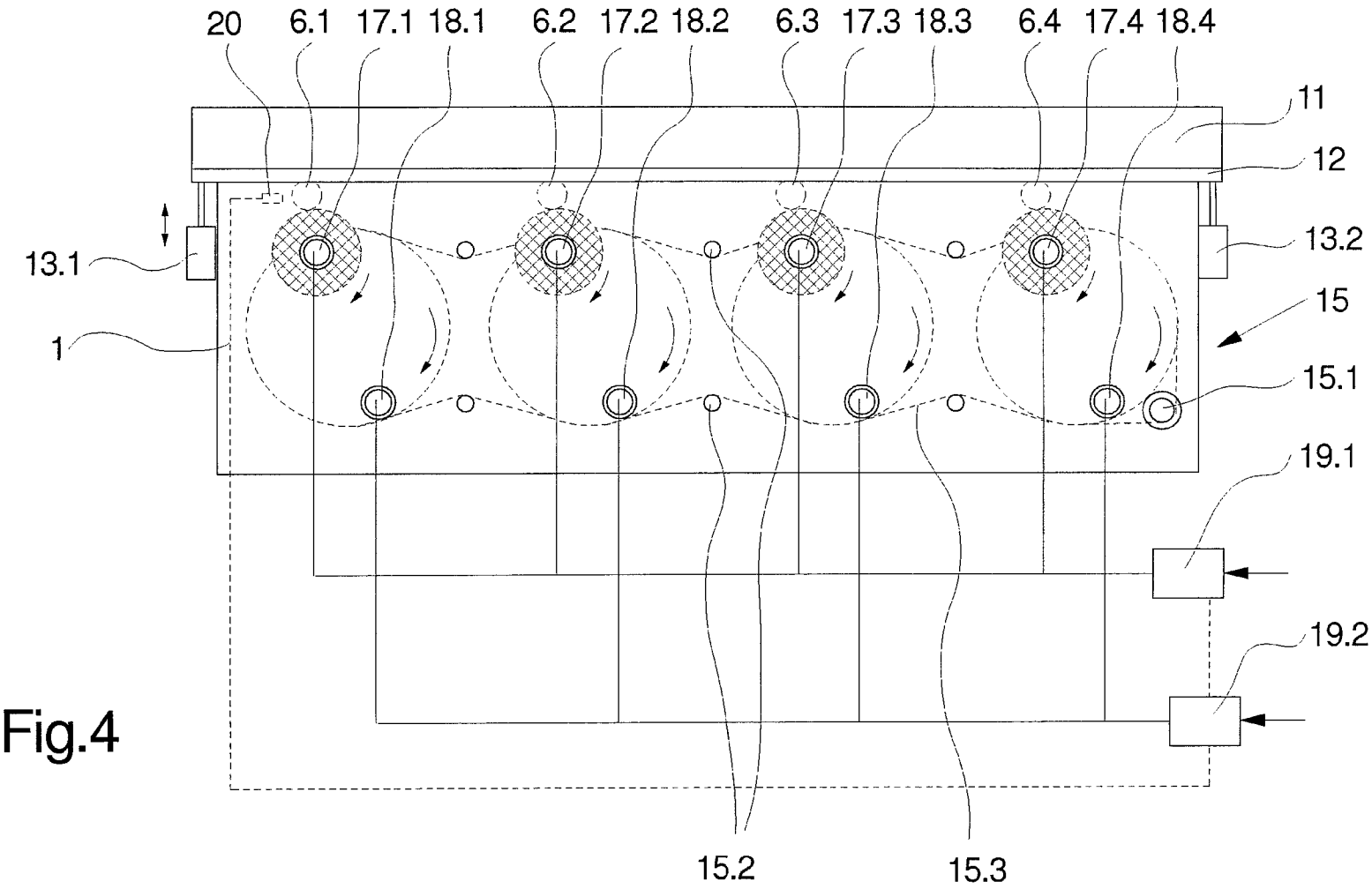

The take-up winding machine according to the invention is explained in more detail below by means of an exemplary embodiment with reference to the appended figures. In the figures:

FIG. 1 schematically shows a front view of a machine longitudinal side of the exemplary embodiment of the take-up winding machine according to the invention;

FIG. 2 schematically shows a side view, transverse to the machine longitudinal side of the exemplary embodiment of FIG. 1;

FIG. 3 schematically shows a plan view of the exemplary embodiment of FIG. 1;

FIG. 4 schematically shows a rear view of the machine longitudinal side of the exemplary embodiment of FIG. 1.

A first exemplary embodiment of the take-up winding machine according to the invention is illustrated in a plurality of views in FIGS. 1 to 4. FIG. 1 shows a front view of a machine longitudinal side of the take-up winding machine, FIG. 2 shows a side view, transverse to the machine longitudinal side, FIG. 3 shows a plan view, and FIG. 4 shows a rear view of the machine longitudinal side of the exemplary embodiment. In as far as no explicit reference is made to any one of the figures, the following description will apply to all figures.

The exemplary embodiment of the take-up winding machine according to the invention has a plurality of winding turrets 2.1 to 2.4, which are disposed beside one another so as to be in each case rotatably mounted in a machine frame 1. The winding turrets 2.1 to 2.4, beside one another, form a machine longitudinal side of the take-up winding machine.

Each of the winding turrets 2.1 to 2.4 supports in each case two protruding winding spindles for receiving winding tubes on the circumference of which in each case one thread is coilable to form one package.

As can be seen from FIGS. 1 and 4, the first winding spindles which are held on the winding turrets 2.1 to 2.4 are identified with the reference signs 4.1 to 4.4. The first winding spindles 4.1 to 4.4, on a rear side in relation to the machine longitudinal side, are assigned the spindle drives 17.1 to 17.4. The spindle drives 17.1 to 17.4 are collectively driven by way of a group controller 19.1.

The second winding spindles which are held on the winding turrets 2.1 to 2.4 are identified with the reference signs 5.1 to 5.4. The second winding spindles 5.1 to 5.4 are held on the winding turrets 2.1 to 2.4 so as to be offset in each case by 180° in relation to the first winding spindles 4.1 to 4.4 on the winding turrets 2.1 to 2.4. The second winding spindles 5.1 to 5.4 are assigned separate spindle drives which in FIG. 4 are identified with the reference signs 18.1 to 18.4. The spindle drives 18.1 to 18.4 are controlled by way of a group controller 19.2.

In the situation illustrated in FIG. 1, the first winding spindles 4.1 to 4.4 are held in an upper position in order to coil a package. The second winding spindles 5.1 and 5.4 are held in a lower changeover position.

The winding spindles 4.1 to 4.4 and 5.1 to 5.4, in order to continuously coil threads, may be pivoted by the rotation movement of the winding turrets 2.1 to 2.4. As can be seen from FIG. 4, a common turret drive 15 is assigned to the winding turrets 2.1 to 2.4. In this exemplary embodiment the turret drive 15 is formed by an electric motor 15.1 and a belt drive 15.2. The belt drive 15.2 has a revolving gear belt 15.3 which, for transmitting a torque, is linked to the winding turrets 2.1 to 2.4. The winding turrets 2.1 to 2.4 can thus be moved in a synchronous manner by the turret drive 15.

The belt drive 15.2 which in FIG. 4 is schematically indicated by dashed lines is advantageously implemented also as a chain drive. It is essential here that the angles of rotation which are specified by the electric motor 15.1, which is preferably implemented by a step motor, are transmitted in a positionally precise and synchronous manner to all winding turrets 2.1 to 2.4.

As can be seen in particular from FIGS. 1 and 2, the winding turrets 2.1 to 2.4 with assigned contact rollers and traversing units collectively form in each case one coiling position 3.1 to 3.4. In the coiling positions 3.1 to 3.4, in order to coil threads the winding spindles 4.1 to 4.4 interact with a contact roller and a traversing unit. In this way, the coiling position 3.1 is assigned the contact roller 6.1 and the traversing unit 7.1. The contact rollers 6.1 to 6.4 and the traversing units 7.1 to 7.4 are disposed so as to be symmetrically beside one another, wherein a pitch which is predefined by the winding turrets 2.1 to 2.4 is also equal to a pitch between the adjacent contact rollers 6.1 to 6.4 and equal to a pitch between the traversing units 7.1 to 7.4. To this extent, each coiling position 3.1 to 3.4 is implemented in an identical manner. The coiling positions 3.1 to 3.4 thus extend along a machine longitudinal side of the take-up winding machine. The machine longitudinal side of the take-up winding machine runs parallel with a so-called doffing aisle which serves for conveying away the completely coiled packages. In this way, the coiling positions 3.1 to 3.4 can be serviced from the doffing aisle which runs parallel with the machine longitudinal side.

As can be seen from the illustration in FIG. 1, the contact rollers 6.1 to 6.4 of the coiling positions 3.1 to 3.4 are collectively held so as to be rotatable on a roller support 12. The roller support 12 is movably guided on the machine frame 1, wherein the movements of the roller support 12 are executed by the lifting cylinders 13.1 and 13.2 on the machine frame 1. A traverse support 11 which supports the traversing units 7.1 to 7.4 is supported above the roller support 12.

As can be seen in particular from FIGS. 2 and 3, the coiling positions 3.1 and 3.4 are in each case configured for one thread, such that only one thread may be coiled to form a package per coiling position 3.1 to 3.4.

It should be explicitly stated at this point that the coiling positions 3.1 to 3.4 may also be readily configured for multiple threads, such that a plurality of threads may be coiled to simultaneously form packages per coiling position 3.1 to 3.4.

In the single-thread embodiments of the coiling positions 3.1 to 3.4 which are in particular illustrated in FIGS. 2 and 3, the traversing units 7.1 to 7.4 per coiling position 3.1 to 3.4 are implemented by way of a wing-type traversing unit 8 having two rotor wings 9.1 to 9.2 which rotate in opposite directions. The rotor wings 9.1 and 9.2 guide the thread in an alternating manner along a guide ruler 21, so as to coil in each case one cross-wound package on the assigned winding spindle 4.1 to 4.4. The wing-type traversing installations 8 of the traversing units 7.1 to 7.4 are collectively driven by way of a traverse drive 16. The traverse drive 16 in this exemplary embodiment is implemented by way of an electric motor 16.1 and a belt drive 16.2. Within the wing-type traversing installation a transfer case 10 serves for distributing the rotary drive to both rotor wings 9.1 and 9.2 which revolve in opposite directions. The belt drive 16.2 of the traverse drive 16 is schematically illustrated in FIG. 3, wherein the drive output wheels and the drive input wheels are not described in more detail here.

As can be seen from the illustration in FIG. 1, infeeding of the threads to the coiling positions 3.1 to 3.4 is performed by deflection rollers 14.1 to 14.4. The deflection rollers 14.1 to 14.4 are distributed across the coiling positions 3.1 and 3.4 and enable flexible infeeding of the threads from an upstream spinning installation. In FIG. 1, a godet 22 is laterally disposed in an exemplary manner beside the coiling positions 3.1 to 3.4, in order to supply a thread group to the coiling positions 3.1 to 3.4, wherein separation of the threads is performed by the deflection rollers 14.1 to 14.4.

The exemplary embodiment of the take-up winding machine according to the invention coils the threads in the coiling positions 3.1 to 3.4 to form packages in a synchronous manner. In this way, the traversing units 7.1 to 7.4 and the winding spindles 4.1 to 4.4 are driven in a synchronous manner by way of the assigned drives. Placement of the threads onto the package surfaces is performed by the contact rollers 6.1 to 6.4 which bear on the circumference of the package which is being coiled in each case. In order to obtain a constant coiling speed in the case of an increasing package, the revolutions by way of a revolution sensor 20 on one of the contact rollers 6.1 to 6.4 are acquired and kept constant via the controller of the spindle drives 17.1 to 17.4, as can be seen from the illustration in FIG. 4.

In order to enable the package to grow, a yielding movement in the coiling positions 3.1 to 3.4 may be implemented by the roller support 12 or alternatively by the winding turrets 2.1 to 2.4.

As soon as the packages which are being coiled on the winding spindles 4.1 to 4.4 have reached a desired package diameter, a changeover of winding spindles is initiated, wherein the winding turrets 2.1 to 2.4 are driven in a synchronous manner by way of the turret drive 15. In this way, the second winding spindle 5.1 to 5.4 may be pivoted into the upper position for receiving the thread and for commencing coiling of a new package.

The take-up winding machine according to the invention is thus distinguished in that a plurality of coiling positions which may be assigned to one or a plurality of spinning positions can be operated with low control complexity. In order for operability of the machine and transmission of the synchronous drives to be ensured, the take-up winding machine according to the invention preferably has fewer than five winding turrets which rotate in the same direction.

LIST OF REFERENCE SIGNS

1 Machine frame
2.1-2.4 Winding turret
3.1-3.4 Coiling position
4.1-4.4 First winding spindle
5.1-5.5 Second winding spindle
6.1-6.4 Contact roller
7.1-7.4 Traversing unit
8 Wing-type traversing installation
9.1, 9.2 Rotor wing
10 Transfer case
11 Traverse support
12 Roller support
13.1, 13.2 Lifting cylinder
14.1-14.4 Deflection roller
15 Turret drive
15.1 Electric motor
15.2 Belt drive
15.3 Gear belt
16 Traverse drive
16.1 Electric motor
16.2 Belt drive
17.1-17.4 Spindle drive
18.1-18.4 Spindle drive
19.1, 19.2 Group controller
20 Revolution sensor
21 Guide ruler
22 Godet

The invention claimed is:

1. A take-up winding machine for continuously coiling a plurality of threads, comprising:

a plurality of rotatably mounted winding turrets which in each case support two protruding winding spindles and which are held beside one another in a machine frame so as to be spaced apart by a pitch, a plurality of traversing units and a plurality of contact rollers which together with the winding turrets form a plurality of coiling positions, wherein the winding turrets are assigned one common turret drive, wherein the winding turrets are configured so as to be drivable in the same direction and in a synchronous manner, and wherein the contact rollers and the traversing units are held on the machine frame along one machine longitudinal side so as to be symmetrical to the pitch of the winding turrets.

2. The take-up winding machine as claimed in claim 1, wherein the turret drive of the winding turrets is formed by an electric motor and a belt drive and/or a chain drive.

3. The take-up winding machine as claimed in claim 1 wherein the traversing units are held beside one another by a traverse support, which traverse support extends above the winding turrets along the coiling positions.

4. The take-up winding machine as claimed in claim 3, wherein the contact rollers are held beside one another by a roller support, and wherein the roller support is movably guided on the machine frame.

5. The take-up winding machine as claimed in claim 3 wherein the traverse support is held on the machine frame by a roller support.

6. The take-up winding machine as claimed in claim 5, wherein the traversing units in the coiling positions are formed by in each case one wing-type traversing installation by way of rotor wings which are drivable in opposite directions, and wherein the wing-type traversing installations are collectively drivable by way of one traverse drive.

7. The take-up winding machine as claimed in claim 6, wherein the traverse drive is formed by an electric motor and a belt drive, wherein each of the wing-type traversing installations is assigned one of a plurality of transfer cases.

8. The take-up winding machine as claimed in claim 7, wherein the winding spindles on the winding turrets are assigned separate winding drives, and wherein the winding drives of one group of winding spindles are collectively controlled by way of one group controller.

9. The take-up winding machine as claimed in claim 8, wherein the group controller is linked to a revolution sensor which is assigned to one of the contact rollers.

10. The take-up winding machine as claimed in claim 9, wherein a plurality of deflection rollers which are held so as to be distributed across the coiling positions are disposed above the traversing units.

11. The take-up winding machine as claimed in claim 10, wherein the coiling positions are configured in such a manner that per coiling position one thread is coiled to form one package or a plurality of threads are coiled to form a plurality of packages.

12. A take-up winding machine for continuously coiling a plurality of threads, comprising:

a plurality of rotatably mounted winding turrets which in each case support two protruding winding spindles and which are held beside one another in a machine frame so as to be spaced apart by a pitch, a plurality of traversing units and a plurality of contact rollers which together with the winding turrets form a plurality of coiling positions, wherein the winding turrets are assigned one common turret drive, wherein the winding turrets are configured so as to be drivable in the same direction, wherein the contact rollers and the traversing units are held on the machine frame along one machine longitudinal side so as to be symmetrical to the pitch of the winding turrets, wherein the traversing units are held beside one another by a traverse support, which traverse support extends above the winding turrets along the coiling positions, and wherein the traverse support is held on the machine frame by a roller support.

13. The take-up winding machine as claimed in claim 12, wherein the contact rollers are held beside one another by the roller support, and wherein the roller support is movably guided on the machine frame.

14. The take-up winding machine as claimed in claim 12, wherein the traversing units in the coiling positions are formed by in each case one wing-type traversing installation by way of rotor wings which are drivable in opposite directions, and wherein the wing-type traversing installations are collectively drivable by way of one traverse drive.

15. The take-up winding machine as claimed in claim 14, wherein the traverse drive is formed by an electric motor and a belt drive, wherein each of the wing-type traversing installations is assigned one of a plurality of transfer cases.

16. The take-up winding machine as claimed in claim 15, wherein the winding spindles on the winding turrets are assigned separate winding drives, and wherein the winding drives of one group of winding spindles are collectively controlled by way of one group controller.

17. The take-up winding machine as claimed in claim 16, wherein the group controller is linked to a revolution sensor which is assigned to one of the contact rollers.

18. The take-up winding machine as claimed in claim 17, wherein a plurality of deflection rollers which are held so as to be distributed across the coiling positions are disposed above the traversing units.

19. The take-up winding machine as claimed in claim 18, wherein the coiling positions are configured in such a manner that per coiling position one thread is coiled to form one package or a plurality of threads are coiled to form a plurality of packages.

* * * * *